US009839945B2

(12) United States Patent
Montgomery et al.

(10) Patent No.: US 9,839,945 B2
(45) Date of Patent: Dec. 12, 2017

(54) METHODS, SYSTEMS, AND APPARATUSES FOR PERFORMING A QUICK CYCLE IN A DISHWASHER

(71) Applicant: ELECTROLUX HOME PRODUCTS, INC., Charlotte, NC (US)

(72) Inventors: Mark D. Montgomery, Kinston, NC (US); Virgil J. Francisco, Kinston, NC (US); Mark W. Oglesby, Kinston, NC (US)

(73) Assignee: ELECTROLUX HOME PRODUCTS, INC., Charlotte, NC (US)

( * ) Notice: Subject to any disclaimer, the term of this patent is extended or adjusted under 35 U.S.C. 154(b) by 0 days.

(21) Appl. No.: 15/300,836

(22) PCT Filed: May 2, 2014

(86) PCT No.: PCT/US2014/036519
§ 371 (c)(1),
(2) Date: Sep. 30, 2016

(87) PCT Pub. No.: WO2015/167574
PCT Pub. Date: Nov. 5, 2015

(65) Prior Publication Data

US 2017/0119229 A1 May 4, 2017

(51) Int. Cl.
*B08B 3/08* (2006.01)
*B08B 3/02* (2006.01)
(Continued)

(52) U.S. Cl.
CPC ..... *B08B 3/10* (2013.01); *A47L 15/0023* (2013.01); *A47L 15/0028* (2013.01);
(Continued)

(58) Field of Classification Search
CPC .... B08B 3/00; B08B 3/02; B08B 3/04; B08B 3/10; B08B 2203/007; B08B 2203/02;
(Continued)

(56) References Cited

U.S. PATENT DOCUMENTS 2,692,602 A * 10/1954 Ullman, Jr. ..... A47L 15/4259 134/186
3,160,170 A 12/1964 Sampsel
(Continued)

FOREIGN PATENT DOCUMENTS

CH 665547 A5 5/1988
DE 28 18 062 A1 3/1980
(Continued)

OTHER PUBLICATIONS

International Searching Authority, International Search Report and Written Opinion for International Application No. PCT/US2014/036519, dated Jan. 20, 2015, 16 pages, The Netherlands.

*Primary Examiner* — Saeed T Chaudhry
(74) *Attorney, Agent, or Firm* — Alston & Bird LLP

(57) ABSTRACT

Method for operating a shortened dishwashing cycle of a dishwasher, dishwasher configured for running the shortened dishwashing cycle and computer program product for operating a shortened dishwashing cycle of a dishwasher. The dishwasher (10) includes a tub (12) configured to hold dishware during a dishwashing cycle, at least one circulation pump (50, 250), at least one heating element (230), and a controller (40, 240) configured to operate the dishwasher. The controller (40, 240) is configured to operate the dishwasher (10) according to at least one of a normal dishwashing cycle or the shortened dishwashing cycle. The method includes providing a first amount of warm water to the tub (12). The first amount of warm water is greater than a standard amount of water provided to the tub (12) for the normal dishwashing cycle. The method further includes,
(Continued)

while the first amount of warm water is being provided into the tub (12), pulsing the circulation pump (50, 250) based on a predetermined timing sequence and activating the heating element (230) to heat the water within the tub (12).

27 Claims, 6 Drawing Sheets

(51) Int. Cl.

| | |
|---|---|
| ***A47L 15/02*** | (2006.01) |
| ***B08B 3/10*** | (2006.01) |
| ***A47L 15/00*** | (2006.01) |
| ***A47L 15/42*** | (2006.01) |
| ***A47L 15/44*** | (2006.01) |

(52) U.S. Cl.
CPC ..... *A47L 15/0031* (2013.01); *A47L 15/0034* (2013.01); *A47L 15/0044* (2013.01); *A47L 15/4297* (2013.01); *A47L 15/44* (2013.01); *A47L 2401/03* (2013.01); *A47L 2401/09* (2013.01); *A47L 2401/12* (2013.01); *A47L 2401/20* (2013.01); *A47L 2501/01* (2013.01); *A47L 2501/02* (2013.01); *A47L 2501/05* (2013.01); *A47L 2501/06* (2013.01); *A47L 2501/07* (2013.01); *B08B 2203/007* (2013.01); *B08B 2203/02* (2013.01)

(58) Field of Classification Search
CPC ..... A47L 15/0044; A47L 15/0023; A47L 15/0028; A47L 15/0031; A47L 15/0034; A47L 15/4297; A47L 15/44; A47L 2401/03; A47L 2401/09; A47L 2401/12; A47L 2401/29; A47L 2501/01; A47L 2401/02; A47L 2401/05; A47L 2401/06; A47L 2401/07
See application file for complete search history.

(56) References Cited

U.S. PATENT DOCUMENTS

| | | | | |
|---|---|---|---|---|
| 5,257,171 | A | 10/1993 | Hara | |
| 5,409,023 | A | 4/1995 | Santarossa et al. | |
| 5,443,655 | A | 8/1995 | Stover et al. | |
| 5,470,142 | A * | 11/1995 | Sargeant | A47L 15/0084 312/258 |
| 5,525,161 | A | 6/1996 | Milocco et al. | |
| 5,560,060 | A | 10/1996 | Dausch et al. | |
| 5,634,227 | A | 6/1997 | Lim | |
| 7,195,023 | B2 | 3/2007 | McKee et al. | |
| 7,332,041 | B2 | 2/2008 | McKee et al. | |
| 7,988,789 | B2 | 8/2011 | Elick et al. | |
| 8,608,866 | B2 | 12/2013 | Francisco et al. | |
| 2003/0188767 | A1 | 10/2003 | Durfee | |
| 2004/0236522 | A1 | 11/2004 | Howes, Jr. et al. | |
| 2004/0255976 | A1 | 12/2004 | DuHack et al. | |
| 2005/0005952 | A1 | 1/2005 | Bashark | |
| 2005/0178406 | A1 | 8/2005 | Kang | |
| 2007/0017551 | A1 | 1/2007 | Hartogh | |
| 2008/0190453 | A1 | 8/2008 | Hildenbrand | |
| 2009/0038644 | A1 | 2/2009 | Fauth et al. | |
| 2010/0229893 | A1 | 9/2010 | Herrmann | |
| 2011/0000510 | A1 * | 1/2011 | Mersch | A47L 15/0015 134/25.2 |
| 2011/0114141 | A1 | 5/2011 | Classen et al. | |
| 2011/0226287 | A1 | 9/2011 | Elick et al. | |
| 2011/0297189 | A1 | 12/2011 | Gram et al. | |
| 2012/0145194 | A1 | 6/2012 | Jerg et al. | |
| 2012/0145200 | A1 | 6/2012 | Jerg et al. | |
| 2013/0025637 | A1 | 1/2013 | Francisco et al. | |
| 2014/0158163 | A1 * | 6/2014 | Montgomery | A47L 15/0018 134/18 |
| 2017/0105596 | A1 * | 4/2017 | Poyner | A47L 15/0044 |

FOREIGN PATENT DOCUMENTS

| | | | |
|---|---|---|---|
| DE | 35 27 046 | A1 | 2/1987 |
| DE | 35 27 047 | A1 | 2/1987 |
| DE | 38 39 200 | A1 | 5/1990 |
| DE | 42 22 240 | A1 | 1/1994 |
| DE | 42 38 450 | A1 | 5/1994 |
| DE | 196 51 297 | A1 | 6/1998 |
| DE | 197 58 064 | A1 | 7/1999 |
| DE | 198 28 768 | A1 | 1/2000 |
| DE | 20 2006 002561 | U1 | 6/2006 |
| DE | 10 2007 056918 | B3 | 4/2009 |
| DE | 10 2007 052085 | A1 | 5/2009 |
| DE | 10 2011 051356 | A1 | 12/2012 |
| DE | 10 2011 051725 | A1 | 1/2013 |
| EP | 0 086 037 | A1 | 8/1983 |
| EP | 0 094 357 | A1 | 11/1983 |
| EP | 0 685 198 | A1 | 12/1995 |
| EP | 0 779 056 | A2 | 6/1997 |
| EP | 1 023 868 | A2 | 8/2000 |
| EP | 1 029 498 | A2 | 8/2000 |
| EP | 1 030 236 | A2 | 8/2000 |
| EP | 1 211 344 | A1 | 6/2002 |
| EP | 1 352 605 | A1 | 10/2003 |
| EP | 1 842 478 | A1 | 10/2007 |
| EP | 1 905 339 | A1 | 4/2008 |
| EP | 2 289 388 | A2 | 3/2011 |
| FR | 2 480 104 | A1 | 10/1981 |
| FR | 2 558 713 | A1 | 8/1985 |
| GB | 1 283 681 | A | 8/1972 |
| GB | 2 423 371 | A | 8/2008 |
| JP | 3-236822 | A | 10/1991 |
| JP | 4-97735 | A | 3/1992 |
| JP | 7-59707 | A | 3/1995 |
| JP | 2000-271060 | A | 10/2000 |
| JP | 2001-057957 | A | 3/2001 |
| JP | 2002-263050 | A | 9/2002 |
| JP | 2007-007178 | A | 1/2007 |
| WO | WO 01/18298 | A2 | 3/2001 |
| WO | WO 2007/049177 | A2 | 5/2007 |
| WO | WO 2009/004019 | A1 | 1/2009 |
| WO | WO 2013/016329 | A1 | 1/2013 |

* cited by examiner

| Line Number | Description | Interval Duration (sec) | Pump Motor Speed (rpm) | Water Valve | Pump Motor | Heater | Drain Motor |
|---|---|---|---|---|---|---|---|
| 1 | Fill | 30 | 0 | 1 | 0 | 0 | 0 |
| 2 | Wash/Heat/Fill | 1 | 3100 | 1 | 1 | 1 | 0 |
| 3 | Pause/Heat/Fill | 12 | 0 | 1 | 0 | 1 | 0 |
| 4 | Wash/Heat/Fill | 1 | 3100 | 1 | 1 | 1 | 0 |
| 5 | Pause/Heat/Fill | 10 | 0 | 1 | 0 | 1 | 0 |
| 6 | Wash/Heat/Fill | 1 | 3100 | 1 | 1 | 1 | 0 |
| 7 | Pause/Heat/Fill | 10 | 0 | 1 | 0 | 1 | 0 |
| 8 | Wash/Heat/Fill | 2 | 3100 | 1 | 1 | 1 | 0 |
| 9 | Pause/Heat/Fill | 8 | 0 | 1 | 0 | 1 | 0 |
| 10 | Wash/Heat/Fill | 40 | 3200 | 1 | 1 | 1 | 0 |
| 11 | Wash/Heat | 80 | 3200 | 0 | 1 | 1 | 0 |
| 12 | Drain | 80 | 0 | 0 | 0 | 0 | 1 |

FIG. 5

METHODS, SYSTEMS, AND APPARATUSES FOR PERFORMING A QUICK CYCLE IN A DISHWASHER

CROSS REFERENCE TO RELATED APPLICATION

This application is a National Stage Application, filed under 35 U.S.C. §371, of International Application No. PCT/US2014/036519, filed May 2, 2014, the contents of which are hereby incorporated by reference in their entireties.

FIELD

Embodiments of the present invention relate to dishwashing appliances and, more particularly, to systems, methods, and apparatus capable of cleaning dishware in a shortened time frame.

BACKGROUND

Dishwashers have become an integral part of everyday household use. Consumers place dishware and other utensils onto dishwasher racks inside dishwashers for cleaning. Dishwashers typically clean the dishware with wash systems that utilize spray arms and spray jets to propel water onto the dishware to remove food particles and otherwise clean the dishware.

On average, dishwashers take approximately an hour or more to complete a normal dishwasher cycle. In various situations, a user may not wish to wait an hour or more for the dishwasher to complete a dishwasher cycle. Thus, a need exists for systems, methods, and apparatus that reduce the amount of time needed to effectively wash dishware.

BRIEF SUMMARY

The present invention provides systems, methods, and apparatus that reduce the amount of time needed to effectively wash dishware. In various circumstances, a user may not want to wait for an hour or longer for a dishwasher to complete a normal dishwasher cycle. However, currently available short cycle options still take nearly an hour to complete or can only effectively clean lightly soiled dishware. One method for reducing the length of a dishwasher cycle may be to connect the dishwasher to a higher amperage or higher voltage power supply line so that more power is available for heating water more quickly. Another method for reducing the length of a dishwasher cycle may be to add a supplemental water tank that includes hot water such that water could be held and heated in anticipation of a shortened dishwasher cycle being selected by the user. However, these methods may increase the cost of the dishwasher, require a special power supply line for the dishwasher, and/or expend additional energy to maintain a heated tank of water.

The present invention avoids these undesirable complications while providing a shortened dishwasher cycle. In particular, the present invention provides various techniques for reducing the overall time of operation of a shortened (e.g., quick) cycle. For example, in various embodiments, the dishwasher may be configured to spray water (e.g., wash fluid, rinsing fluid, and/or the like) onto the dishware while the dishwasher is filling with water. In various embodiments, the dishwasher may be overfilled with warm/hot water (e.g., water provided by a hot water supply, water heated before being provided to the dishwasher, and/or the like) during one or more segments to take advantage of the additional thermal energy transfer provided by the additional warm water. In various embodiments, the detergent may be activated and/or dissolved before being released into the dishwasher tub to clean the dishware. Further, in various embodiments, water added to the tub that lost its heat energy while in the supply piping or that has given up much of its stored heat energy to the dish load and tub can be removed and replaced by warm water. For example, in some embodiments, a siphon break device may be used to remove cold water from the tub and additional warm/hot water can be provided to the tub.

In various embodiments of the present invention, a method for operating a shortened dishwasher cycle of a dishwasher is provided. The dishwasher may have a tub configured to hold dishware during a dishwasher cycle, at least one circulation pump, at least one heating element, and a controller configured to operate the dishwasher. The controller is configured to operate the dishwasher according to at least one of a normal dishwasher cycle or the shortened dishwasher cycle. In various embodiments, the method may include providing a first amount of water to the tub. The first amount of water is greater than a standard amount of water provided to the tub for the normal dishwasher cycle. The method may further comprise pulsing the circulation pump based on a predetermined timing sequence to circulate the water within the tub while the first amount of water is being provided to the tub and activating the at least one heating element to heat the water within the tub while the first amount of water is being provided to the tub.

In various embodiments, the method may further include releasing detergent into the tub while the first amount of water is being provided to the tub. In some embodiments, the method may further include charging the detergent, as defined later herein, prior to releasing the detergent into the tub. The method may also include actuating the circulation pump in a constant manner in response to detecting that a water level within the tub reaches a predetermined water level. In various embodiments, activating the at least one heating element comprises pulsing the at least one heating element according to a second predetermined timing sequence. In various embodiments, the predetermined timing sequence is defined such that a length of time of subsequent pauses of the circulation pump decreases as an estimated or monitored current water level within the tub increases. In some embodiments, the predetermined timing sequence is defined such that a length of time of subsequent activation periods of the circulation pump varies in a manner proportional to an estimated or monitored current water level within the tub. In various embodiments, the predetermined timing sequence is defined such that a length of time of subsequent activation periods of the circulation pump varies in a manner based on an estimated or monitored current water level within the tub during each activation period such that enough water is present to properly operate the circulation pump. The dishwasher may further include a siphon break device and the method may further include removing cool water from the tub via the siphon break device and providing additional warm water to the tub. In various embodiments, providing the first amount of water to the tub that is greater than the standard amount of water provided to the tub for the normal dishwasher cycle causes a first rate of temperature increase within the tub that is greater than a rate of temperature increase within the tub portion during a normal dishwasher cycle. In various embodiments, the method may further comprise draining, after a predetermined amount of time, a third amount of water from within the tub such that a remaining water level within the tub defines a normal operation water level.

In various embodiments, the method may further comprise, prior to providing the first amount of water to the tub, providing water to the tub for a first pre-determined amount of time and draining the water from the tub so as to clear cold water from a water supply line 24. In some embodiments the method may further comprise, prior to providing the first amount of water to the tub providing water to the tub for a first pre-determined amount of time, comparing a temperature of the water to a threshold temperature of the water, and draining the water from the tub if the monitored temperature is below the threshold temperature so as to clear cold water from a water supply line 24. Additionally, in some embodiments, the method may further comprise repeating the steps of providing water, comparing the temperature, and draining the water if the monitored temperature is below the threshold temperature until at least one of the following occurs: a threshold volume of water has been provided to the tub; a threshold amount of time has elapsed; the monitored temperature reaches the threshold temperature; or the monitored temperature stops increasing from a previous iteration In various embodiments, a dishwasher configured for running a shortened dishwasher cycle is provided. The dishwasher may include a tub configured to hold dishware during a dishwasher cycle; a water fill valve configured to cause water to flow into the tub; a circulation pump configured to cause the water within the tub to be circulated within the tub; at least one heating element configured to cause the water within the tub to be heated; and a controller in communication with the water fill valve, the water circulation pump, and the at least one heating element. The controller may be configured to operate the dishwasher according to at least one of a normal dishwasher cycle or the shortened dishwasher cycle. The controller may be configured to actuate the water fill valve to provide a first amount of water to the tub, wherein the first amount of water is greater than a standard amount of water provided to the tub for the normal dishwasher cycle; pulse the circulation pump based on a predetermined timing sequence to circulate the water within the tub while the first amount of water is being provided to the tub; and activate the at least one heating element to heat the water within the tub while the first amount of water is being provided to the tub.

In various embodiments, the dishwasher may further include a detergent dispenser. The controller may be further configured to cause the detergent dispenser to release detergent into the tub while the first amount of water is being provided to the tub. In some embodiments, the detergent dispenser may be configured such that the detergent is charged by the addition of water to the detergent dispenser prior to the detergent being released into the tub. In some embodiments, the controller may be configured to cause the heating element to be actuated in a pulsed manner, according to a second predetermined timing sequence. In various embodiments, the predetermined timing sequence is defined such that a length of time of subsequent pauses of the circulation pump decreases as an estimated or monitored current water level within the tub increases. In some embodiments, the predetermined timing sequence is defined such that a length of time of subsequent activation periods of the circulation pump varies in a manner proportional to an estimated or monitored current water level within the tub. In various embodiments, the predetermined timing sequence is defined such that a length of time of subsequent activation periods of the circulation pump varies in a manner based on an estimated or monitored current water level within the tub during each activation period such that enough water is present to properly operate the circulation pump. In various embodiments, the dishwasher may further include a siphon break device configured to enable either partial or full removal of cool water from the tub and the controller may be configured to provide additional warm water to the tub.

In various embodiments, a computer program product for operating a shortened dishwasher cycle of a dishwasher is provided. The dishwasher may include a tub configured to hold dishware during a dishwasher cycle, at least one circulation pump, at least heating element, and a controller configured to operate the dishwasher. The controller is configured to operate the dishwasher according to at least one of a normal dishwasher cycle or the shortened dishwasher cycle. The computer program product includes a non-transitory computer readable medium having program code portions stored thereon. The program code portions being a computer readable medium and configured, when the program product is run on the controller, to provide a first amount of water to the tub. The first amount of water is greater than a standard amount of water provided to the tub for a normal dishwasher cycle. The program code portions, when run on the controller, may be further configured to pulse the circulation pump based on a predetermined sequence to circulate the water within the tub while the first amount of water is being provided to the tub, and activate the at least one heating element to heat the water within the tub while the first amount of water is being provided to the tub.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

FIG. 5 is a timing diagram for an example segment of a quick cycle dishwasher cycle, in accordance with some embodiments discussed herein.

DETAILED DESCRIPTION OF VARIOUS EMBODIMENTS

The present invention now will be described more fully hereinafter with reference to the accompanying drawings, in which some, but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Figure 1:
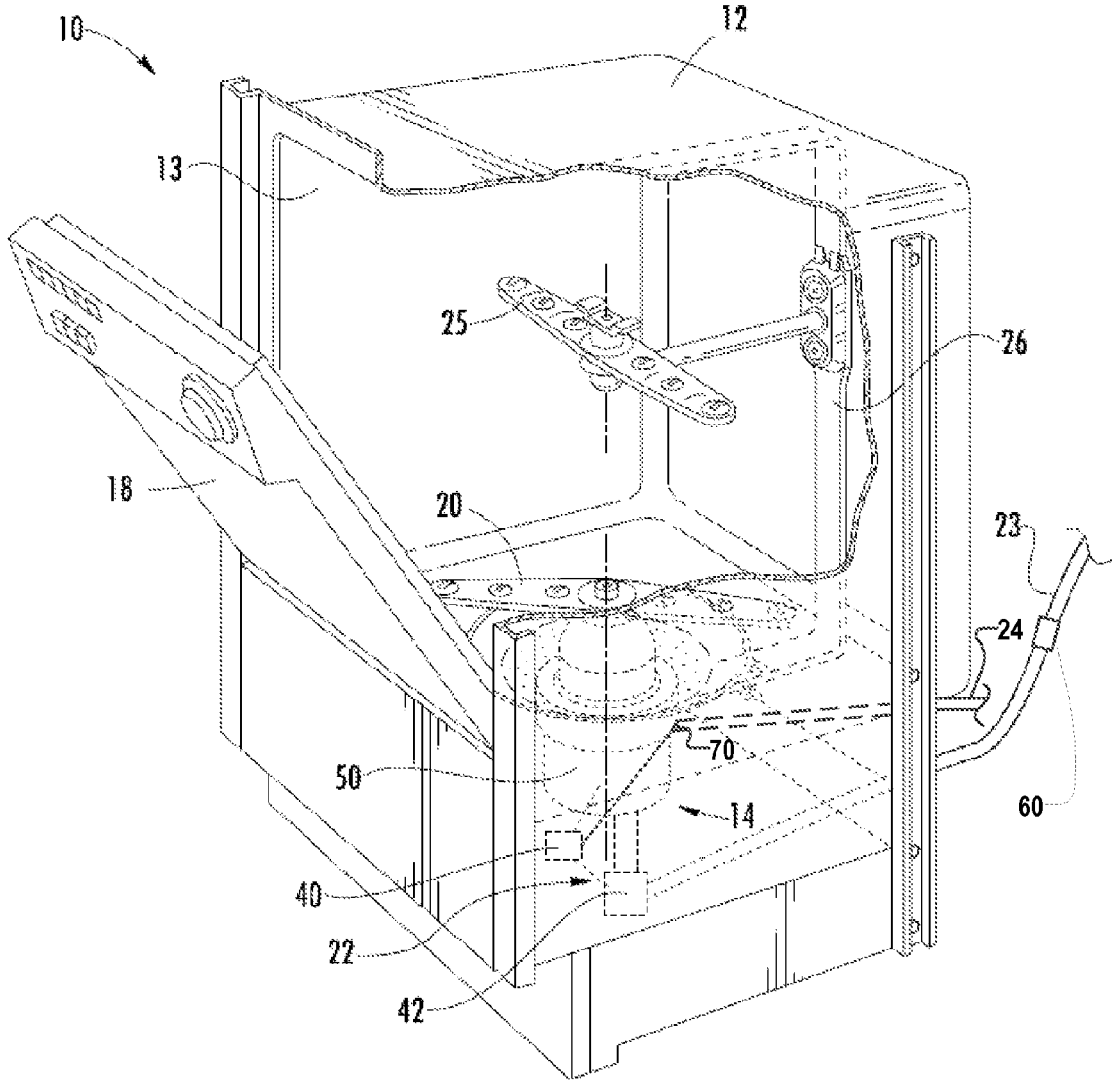
FIG. 1 is a perspective view of a dishwasher, in accordance with some embodiments discussed herein.

FIG. 1 illustrates one example of a dishwasher 10 capable of implementing various embodiments of the present invention. Such a dishwasher 10 typically includes a tub 12 (partly broken away in FIG. 1 to show internal details), having a plurality of walls (e.g., side wall 13) for forming an enclosure in which dishes, utensils, and other dishware may be placed for washing. As known in the art, the dishwasher 10 may also include slidable lower and upper racks (not shown) for holding the dishes, utensils, and dishware. A door 18 may be pivotably engaged with the tub 12 to selectively permit access to the interior of the tub 12. The door 18 closes to cover and seal the tub 12 when the dishwasher is in operation.

The tub 12 may include a sump 14 in which water, wash fluid, or rinse fluid (herein collectively referred to as water) is collected, typically under the influence of gravity. The water may be pumped by a circulation pump 50 (such as through circulation conduit 26) to one or more spray arms (e.g., lower spray arm 20 and/or middle spray arm 25) mounted in the interior of the tub 12 for spraying the water, under pressure, onto the dishes, utensils, and other dishware contained therein. When the end of a wash or rinse segment has been reached, the water is typically pumped out of the tub 12 (e.g., via drain hose 23) by a drain pump 42. In various embodiments, the dishwasher 10 may further include a siphon break device 60 comprising one or more apertures configured to selectively vent in air from the atmosphere to relieve a vacuum within the drain hose 23 and/or other drain conduit.

The dishwasher 10 may also comprise a controller 40 that may be in communication with one or more of the operational components of the dishwasher 10. For example, the controller 40 may be in communication with the circulation pump 50 and may be configured to selectively operate the circulation pump 50 to pump water to at least one spray arm and/or spray jet. In various embodiments, the controller 40 may be in communication with the drain pump 42 and may be configured to selectively operate the drain pump 42 to pump water out of the tub 12 (e.g., via the drain hose 23). Additionally, the controller 40 may be in communication with a water fill valve 70 and may be configured to selectively activate (e.g., open, turn ON, etc.) the water fill valve to direct water from a fluid supply/source 24 to the tub 12 of the dishwasher 10. As noted herein, the water from the fluid supply/source 24 may be warm water. The controller may also be configured to deactivate (e.g., close, turn OFF, etc.) the water fill valve 70 to stop directing water to the tub 12. In some embodiments, the controller 40 may comprise a processor or other computing means such that operations can be performed in the dishwasher. Additionally or alternatively, the controller 40 may comprise a memory for storage of data such as routines for operation of the dishwasher. In some embodiments, the controller 40 may be housed in the lower end 22 of the dishwasher 10. In other embodiments, the controller 40 may be housed in the door 18 of the dishwasher 10 or other location within the dishwasher.

Figure 2:
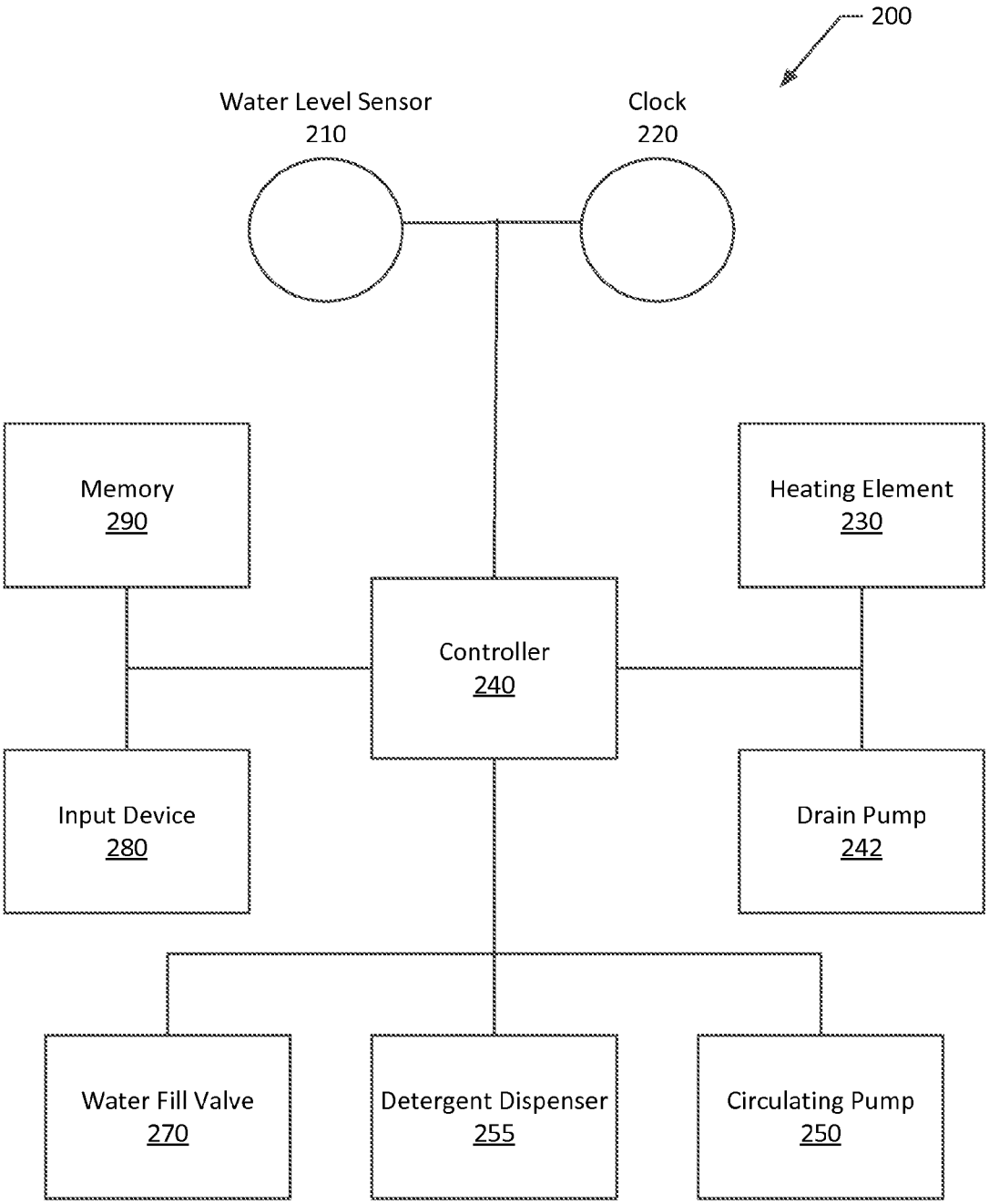
FIG. 2 is a block diagram of selective components of a dishwasher, in accordance with some embodiments discussed herein.

FIG. 2 provides a block diagram illustrating some of the components of an example dishwasher 200 (e.g., dishwasher 10) according to various embodiments of the present invention. For example, the dishwasher 200 may include one or more sensors and/or switches (e.g., water level sensor 210) in communication with a controller 240 (e.g., controller 40). The controller 240 may be configured to control, adjust, and/or synchronize one or more of the operations of the dishwasher 200, at least partially, based on information received from the sensors and/or switches. The controller 240 may be embodied as a processor(s), coprocessor(s), a controller(s) or various other processing means or devices including, without limitation, integrated circuits.

Examples of sensors include, without limitation, a water level sensor 210, a temperature sensor (not shown), a turbidity sensor (not shown), a humidity sensor (not shown) and/or the like. In some embodiments, the water level sensor 210 may be a device configured to measure the water level of water, wash fluid, and/or rinse fluid in the tub of the dishwasher 200. For example, the water level sensor 210 may measure the water pressure exerted by the water in the tub 12 and/or sump 14 of the dishwasher 200 to determine the level of water within the dishwasher (e.g., through a pressure sensor). In another example, a water level sensor 210 may be a magnetic float level switch. A magnetic float level switch generally comprises a float comprising a permanent magnet. The float is configured to move up and down in the tub with the surface of the water (e.g., float on the fluid within the dishwasher). The float may be ring-shaped and located around a stationary stem comprising one or more mechanisms (e.g., switches) to detect the location of the float along the stem based on the magnetic field of the float. In some embodiments, the turbidity sensor is a device configured to measure the level of opacity (or simply referred to as the "cloudiness") of water or other liquids. In some embodiments, the humidity sensor is a device configured to measure the amount of moisture in or relative humidity of a medium such as air. In some embodiments, the temperature sensor is a device configured to measure the temperature of a medium such as air or water. In various embodiments, the controller 240 may further comprise and/or be in communication with a clock 220. For example, as discussed in detail below, in various embodiments, the controller 240 may be configured to operate various components of the dishwasher 200 based on a pre-determined timing sequence.

In various embodiments, the dishwasher 200 may include, without limitation, one or more heating elements 230, a drain pump 242 (e.g., drain pump 42), a circulation pump 250 (e.g., circulation pump 50), a detergent dispenser 255, a siphon break device, and a water fill valve 270. The controller 240 may be in communication with the one or more sensors 210 and clock 220 such that the controller 240 is configured to receive information (e.g., water/wash fluid level, timing information, level of fluid cloudiness, level of humidity, and temperature). Based on the received information, the controller 240, which is in communication with the components 230, 242, 250, 255, 270 of the dishwasher, may send commands to one or more of the components 230, 242, 250, 255, 270, (e.g., turn on or off, increase or decrease an output, etc.). In addition to or instead of the sensors, the controller 240 may receive instructions or other information from an input device 280, such as a control panel (e.g., a user interface). The dishwasher 200 may further include one or more memory elements 290 configured to store instructions (e.g., a software program) for the controller 240, such as for operating the dishwasher and/or its components according to a dishwasher cycle.

In some embodiments, the dishwasher 200 includes a detergent dispenser 255. In various embodiments, the detergent dispenser 255 may be configured to receive powder, liquid, or some other detergent before a dishwasher cycle is initiated. The detergent dispenser 255 may be configured to release the detergent into the tub 12 of the dishwasher at the appropriate point in the cycle. In various embodiments, the detergent dispenser may be designed so that it charges the detergent prior to releasing it into the tub. For example, the detergent dispenser may be configured to receive water into a trough that holds the detergent. The water may run down the interior surface of the door and into the trough prior to the detergent dispenser releasing the detergent. An example of such a detergent dispenser is described in U.S. Pat. No. 8,608,866 which is herein incorporated by reference in its entirety. In various embodiments, the controller 40 may be configured to activate the detergent dispenser 255 (such as by activating a motor to open the door of the detergent dispenser) to release the detergent into the tub 12.

In various embodiments, the dishwasher 200 may include a siphon break device 60. The siphon break device 60 may be configured to substantially prevent a siphon effect in a fluid conduit, such as described in U.S. Publ. No. 2013/0025637 and Intl. Publ. No. WO 2013/016329, which are both herein incorporated by reference in their entireties. For example, the siphon break device 60 may be located in line with the drain hose 23 and/or other drain conduit. The siphon break device 60 may comprise one or more apertures configured to selectively vent in air from the atmosphere to relieve a vacuum within the drain hose 23 and/or other drain conduit. By relieving the vacuum within the drain conduit, the siphon break device 60 may break the siphon effect within the drain conduit, allowing a selective amount of water to be removed from the tub 12. In particular, in some embodiments, the controller 40 may be configured to activate the drain pump in series with the siphon break device 60 to remove cold water from the tub 12.

In some embodiments, the controller 40 may be configured to operate the dishwasher 10, such as through various components of the dishwasher 10. In this regard, operation of the dishwasher 10 typically includes execution of dishwasher cycles having various parameters of the dishwashing process. In some embodiments, dishwasher cycles may be designed differently such that the components of the dishwasher operate at various times or to various degrees for each dishwasher cycle.

Figure 3:
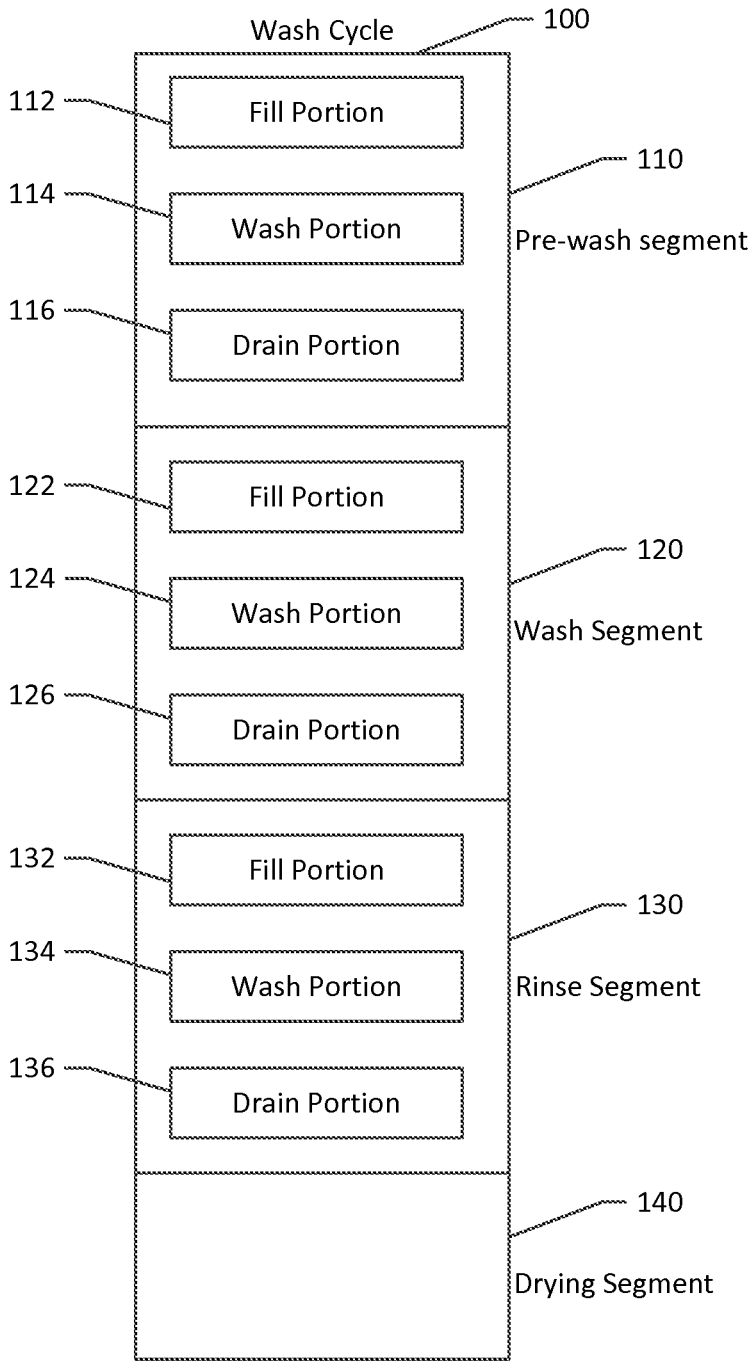
FIG. 3 is a schematic diagram of an example dishwasher cycle, in accordance with some embodiments discussed herein.

In some embodiments, the controller 40 may be configured to operate the dishwasher according to various types of dishwasher cycles. For example, FIG. 3 provides a schematic diagram of a dishwasher cycle 100 that may be performed by a dishwasher (e.g., 10, 200) including one pre-wash segment 110, one wash segment 120, one rinse segment 130, and one drying segment 140. In various embodiments, a dishwasher cycle 100 may include none, one, or a plurality of pre-wash segments 110. In various embodiments, a dishwasher cycle 100 may include one or more wash segments 120 and one or more rinse segments 130. Each segment (except for the drying segment 140) generally comprises a fill portion (e.g., 112, 122, 132), a wash portion (e.g., 114, 124, 134), and a drain portion (e.g., 116, 126, 136). For a normal dishwasher cycle, completion of the pre-wash segment(s), wash segment(s), rinse segment(s), and drying segment takes approximately an hour or longer. In some embodiments, for a shortened (quick) dishwasher cycle, the completion of the cycle takes approximately half an hour or less.

During the fill portion (e.g., 112, 122, 132), a water fill valve 270 may be activated (e.g., by controller 240) to provide water to the tub 12. The water added to tub 12 during the fill portion (e.g., 112, 122, 132) may comprise at least a portion of the water used during that segment. For example, during a normal dishwasher cycle, the water fill valve 270 may be activated to provide a gallon of water to the tub 12.

During the wash portion (e.g., 114, 124, 134), the circulation pump (e.g., 50, 250) may be activated (e.g., by the controller 40, 240) to spray water onto the dishware within the tub 12 (e.g., via spray arms 20, 25 and/or the like). In various embodiments, during a wash segment 120, detergent may be added to the tub 12 during the wash portion 124. Similarly, in some embodiments, a rinse aid may be added to the tub 12 during the wash portion 134 of a rinse segment 130. As used herein, reference to detergent may refer to detergent, enzymes used for washing dishware, rinse aid, and/or the like. In some embodiments, a heating element 230 within the dishwasher 10 may be activated (e.g., by the controller 240) to heat the water within the tub 12 during one or more of the wash portions (e.g., 114, 124, 134). In a normal dishwasher cycle, the wash portion is not initiated until the fill portion is completed.

During the drain portion (e.g., 116, 126, 136), the drain pump (e.g., 42, 242) is activated (e.g., by the controller 40, 240) to drain the water out of the tub 12 (e.g., via drain hose 23). In various embodiments, a dishwasher cycle 100 may also include a drying segment 140 for drying the dishware within the tub 12. In a normal dishwasher cycle, each portion of a segment may be temporally distinct from the other portions of that segment (e.g., the portions of the segment don't overlap in time). For example, activation of the circulation pump may not occur until after the water level has reached the desired height for operation. This may be due to the fact that it is desirable to avoid cavitation (e.g., creation and destruction of vapor bubbles within the circulation pump) or carry under (e.g., drawing in of air) to the circulation pump. This is avoided by having a sufficient water level that provides the necessary pump inlet pressure and enough water volume to the circulation pump for operation while still accounting of water being positioned within the tub but unusable by the circulation pump (e.g., currently circulating through the circulation hose and spray arms, trapped in an upside down glass, running down the walls of the tub, etc.). Additionally, in some cases, activation of the heating element may not occur until after the water level has reached the desired height for operation. This may be due to the fact that the heating element may become damaged if it is dry and water at a much lower temperature contacts it (e.g., resulting in warping and/or thermal fatigue of the heating element). This is avoided by having a sufficient water level to maintain the wetness of the heating element either through a consistent spray of water from the circulation pump 50 through the spray arm(s) 20 and/or 25 or from being submerged while still accounting for water being positioned within the tub but not in contact with the heating element (e.g., currently circulating through the circulation hose and spray arms, trapped in an upside down glass, running down the walls of the tub, etc.).

In a normal dishwasher cycle, a plurality of pre-wash segments, wash segments, and/or rinse segments may be used. For example, a normal dishwasher cycle may include three pre-wash segments, one wash segment, two rinse segments, and one drying segment. In a normal dishwasher cycle, multiple fillings (e.g., multiple pre-wash segments with short wash periods) may allow the tub 12 to be filled multiple times with warm water, allowing the temperature of the dishware within the tub to be efficiently increased (e.g., the warm water being provided to the tub provides for a jump in the temperature within the tub).

Various embodiments of the present invention provide a shortened dishwasher cycle or "quick" cycle. In various embodiments, the shortened dishwasher cycle is characterized in that the cycle only takes approximately half an hour (thirty minutes) or less to complete. Additionally, the shortened dishwasher cycle may be configured to effectively clean dishware that has been lightly, average, or heavily soiled. Similar to the dishwasher cycle 100, a shortened dishwasher cycle may include at least one pre-wash segment, at least one wash segment, at least one rinse segment, and at least one drying segment. Each segment may include a fill portion, a wash portion, and a drain portion. However, unlike the normal dishwasher cycle, each portion of a segment need not be temporally distinct from the other portions of that segment. Various techniques that may be used to provide a shortened dishwasher cycle will now be discussed.

As noted above, the dishwasher 200 comprises a detergent dispenser 255. In various embodiments, the detergent dispenser 255 may be configured to dissolve, charge, or activate (referred to as charging herein) the detergent before the detergent is released into the tub 12. For example, water may be provided to the trough of the detergent dispenser 255 where the detergent is held before the detergent is released. By charging the detergent within the detergent dispenser 255, less time is needed between when the detergent is released into the tub 12 and when the detergent can start to act upon the soil on the dishware.

In various embodiments, the detergent dispenser 255 may be configured to release the detergent, which may or may not be charged, into the tub 12 early in the dishwasher cycle (e.g., early in the wash portion 124). For example, the detergent may be released into the tub 12 approximately simultaneously to the drain pump 42, 242 being deactivated, approximately simultaneously to the water fill valve 270 being activated, approximately simultaneously to the circulation pump 250 being activated, and/or the like. By releasing the detergent into the tub 12 early in the wash portion 124, the detergent may have a longer period of time to act upon the soil on the dishware.

In various embodiments, the water and/or the dishware within the tub 12 may be at and/or near a temperature that optimizes the activity of the detergent. For example, a detergent may provide optimum activity on dishware around 130° F. (54° C.). In one embodiment, the water and/or dishware within the tub 12 may be within the range of 125-135° F. (52-57° C.) when the detergent is released into the tub 12, at some point during the wash portion 124, and/or the like. Given the high heat capacity of water and that most dishwashers are powered by a 15 Amp/120 Volt circuit, the at least one heating element 230 may raise the temperature of the water and/or dishware within the tub 12 by approximately 1° F. per minute. Given the time constraints of a shortened dishwasher cycle for heating of the water and/or dishware within the tub 12, it may not be feasible to depend upon the at least one heating element to significantly heat the water and/or dishware within the tub 12. Similarly, the time needed to perform multiple fills to increase the temperature of the dishware within the tub 12 (e.g., by thermal transfer from the incoming warm water) may cause the length of the dishwasher cycle to be too long for a shortened dishwasher cycle.

Therefore, in various embodiments of the present invention, another method may be used to ensure the dishware with the tub 12 reaches a temperature at which the detergent may optimally and/or effectively operate during the shortened dishwasher cycle. As noted above, the temperature of the dishware within the tub 12 may be increased by adding warm water to the tub. To avoid having to perform multiple drains and fills (e.g., to remove the cooler water and replace it with warm water to effect the thermal transfer), some embodiments of the present invention add additional warm water (e.g., over the expected amount of water needed). To explain, if a normal amount of water is added to the tub during the fill portion of a segment of a normal dishwasher cycle, a larger than normal amount of water is added to the tub during the fill portion of at least one segment of a shortened dishwasher cycle. For example, if during a normal dishwasher cycle the water fill valve is actuated to provide one gallon of warm water to the tub 12, then during the shortened dishwasher cycle the water fill valve may be actuated to provide one and a half gallons of warm water to the tub 12. The heat carried by the extra water may be, in part, transferred to the dishware in the tub 12, causing the temperature of the dishware to increase even more (and more quickly than performing multiple drains/fills). For example, providing the larger than normal amount of water to the tub causes a rate of temperature increase within the tub 12 that is greater than a rate of temperature increase within the tub during a normal dishwasher cycle. In this regard, in some embodiments, the fill portion of the segment is lengthened to account for adding additional water to the tub 12. For example, the water fill valve 270 may be activated for a longer period of time to provide the additional water to the tub 12.

In various embodiments, the wash portion of the segment may overlap with at least one of the filling portion and the draining portion. For example, the circulation pump 250 may be activated by the controller 240 while the water fill valve 270 is still activated to provide water to the tub 12. In some embodiments, the circulation pump 250 may be activated by the controller 240 in a pulsed manner for a pre-determined period of time and/or until the water level within the tub reaches a pre-determined or monitored threshold level. By pulsing the circulation pump 250 to allow time for water to return to the pump inlet, cavitation of the circulation pump and carry under may be prevented. For example, the controller 240 may operate the circulation pump 250 in accordance with a predetermined timing sequence configured to prevent cavitation of the circulation pump. The predetermined timing sequence may be configured such that a length of time of subsequent activation periods of the circulation pump varies in a manner related to the length of time the water fill valve 270 has been activated, an estimated current water level, and/or the monitored current water level within the tub 12. For example, the more water that is in the tub 12, the shorter the pauses between subsequent pulses of the circulation pump 250 need to be to prevent cavitation of the pump. Similarly, the length of each pulse may depend on the length of time the water fill valve 270 has been activated, an estimated current water level, and/or the monitored current water level within the tub 12. For example, the more water in the tub, the circulation pump 250 may operate for a longer period of time without risk of cavitation. After the water fill valve 270 has been activated for a predetermined minimum time and/or the monitored or estimated or monitored current water level within the tub 12 is equal to or greater than a threshold water level, the controller 240 may activate the circulation pump 250 in a continuous manner. In various embodiments, the estimated or monitored current water level in the tub 12 may depend on the length of time the water fill valve 270 (or drain pump 242) has been activated.

In various embodiments, the at least one heating element 230 may be activated by the controller 240 while the water fill valve 270 is still activated to provide water to the tub 12. Thus, the at least one heating element 230 may be activated to heat the water in the tub 12 while water is still being provided to the tub 12. In various embodiments, the controller 240 may activate the at least one heating element 230 in a pulsed manner to prevent overheating of the heating element or one or more components of the heating element or warping/damaging of the heating element (as described above). For example, the controller 240 may operate the at least one heating element 230 in a pulsed manner in accordance with a second predetermined timing sequence configured to prevent over heating of the heating element or one or more components of the heating element or warping/damaging of the heating element. Similar to that described above with respect to the circulation pump 250 predetermined timing sequence, the pauses may shorten and the pulse lengths may lengthen based on the length of time the water fill valve 270 has been activated, an estimated current water level within the tub 12, and/or a monitored current water level within the tub 12. Once the length of time the water fill valve 270 or the estimated or monitored current water level in the tub 12 is equal or greater to a threshold water level, the controller 240 may operate the at least one heating element 230 in a continuous manner.

As noted above, in various embodiments, the dishwasher 200 may comprise a siphon break device 60. In some such embodiments, the siphon break device 60 may be used to enable removal of a predetermined amount of water from the tub 12. For example, the water provided to the tub 12 may have been warm when originally provided, but through interactions with the dishware within the tub 12, has cooled. Some of the cool water from the tub 12 may be removed via the siphon break device. In various embodiments, the amount of cool water removed may not be enough to prevent the continuous actuation of the circulation pump 250 and/or the at least one heating element 230. In other embodiments, a larger volume of cool water may be removed from the tub 12 and the controller 240 may actuate the circulation pump 250 and/or the at least one heating element 230 in accordance with an appropriate predetermined timing sequence to prevent cavitation of the pump and/or overheating/damaging of the heating element or one or more components of the heating element. The volume of cool water removed from the tub 12 may be predetermined based on the length of time the water is being removed from the tub, an estimated current water level within the tub, and/or a monitored current water level within the tub. Once the volume of cool water has been removed from the tub 12, the controller 240 may activate the water fill valve 270 to provide warm water to the tub to add heat to the water within the tub. In various embodiments, the controller 240 may activate the water fill valve to provide warm water to the tub 12 while the removal of cool water from the tub is being completed.

In some embodiments, after a predetermined amount of time or after the water level reaches a threshold water level (e.g., after the dishware within the tub 12 has had time to be heated by the warm water), a volume of water may be removed from the tub such that the water level within the tub is returned to a water level that is similar to the water level in the tub during a normal dishwasher cycle.

In various embodiments, the controller 40 may be configured to ensure the water provided to the tub 12 is warm water before the shortened dishwasher cycle commences (e.g., during a pre-wash segment). For example, in various circumstances the dishwasher 10 may be located a distance from the hot water heater or other heating device used to heat the water before the water is provided to the tub 12 via the water fill valve 270. Thus, the warm water may sit in piping between the hot water heater or other heating device and the dishwasher 10 and cool to room temperature over time. Thus, the controller 40 may be configured to clear the water supply line 24 of water in the piping that has cooled after receiving input indicating that the dishwasher should perform a shortened dishwasher cycle and before the shortened dishwasher cycle begins. In some embodiments, the water fill valve 270 may be configured to operate for a predetermined amount of time. Then, either simultaneously with the water fill valve or after the predetermined amount of time, the drain pump 50 may be configured activate to remove the water from the tub 12, so as to flush out the room temperature water.

In other example embodiments, before the shortened dishwasher cycle begins, the controller 40 may activate the water fill valve 270 for several seconds (e.g., 9-10 seconds) in order to provide some water (e.g., 15-20 fluid ounces) into the tub 12 while monitoring the temperature of the incoming water. If the incoming water is the expected temperature given the water supply (e.g., a set temperature, such as 120° F., the temperature the hot water heater is set to, the average set hot water temperature, and/or the like), the shortened dishwasher cycle may start. If, however, the temperature is low, the controller 40 may activate the drain pump 42 to remove the cool water. Another short fill may then occur and the temperature of the incoming water may be compared to the temperature of the water on the previous fill and to the expected temperature given the water supply. In various embodiments, the short fill and drain sequence may be repeated until one or more of three limits is reached. The first limit may be a cumulative volume of water, cumulative time duration, and/or the like. For example, the controller 40 may iterate the short fill and drain sequence for a predetermined amount of time (e.g., 30 seconds, 1 minute, etc.) or for a predetermined volume of water (e.g., 1 gallon of water, etc.). The second limit may be that the expected temperature (e.g., approximately 120° F.) is reached. Thus, if the temperature of the incoming water is as expected, the shortened dishwasher cycle may commence. The third limit may be if the temperature increases during one short fill, but not during the next short fill. For example, the temperature of the incoming water may have increased to the maximum temperature for that individual water supply but the temperature of the incoming water is still below the expected temperature. In other words, the temperature of the incoming water may increase, but may plateau before reaching the expected temperature. In this situation, the temperature of the incoming water has likely reached the highest temperature it will. In some embodiments, once at least one of these three limits (e.g., a time duration or water volume limit, a target temperature limit, or a plateau limit) has been reached, the shortened dishwasher cycle may begin.

Figure 4:
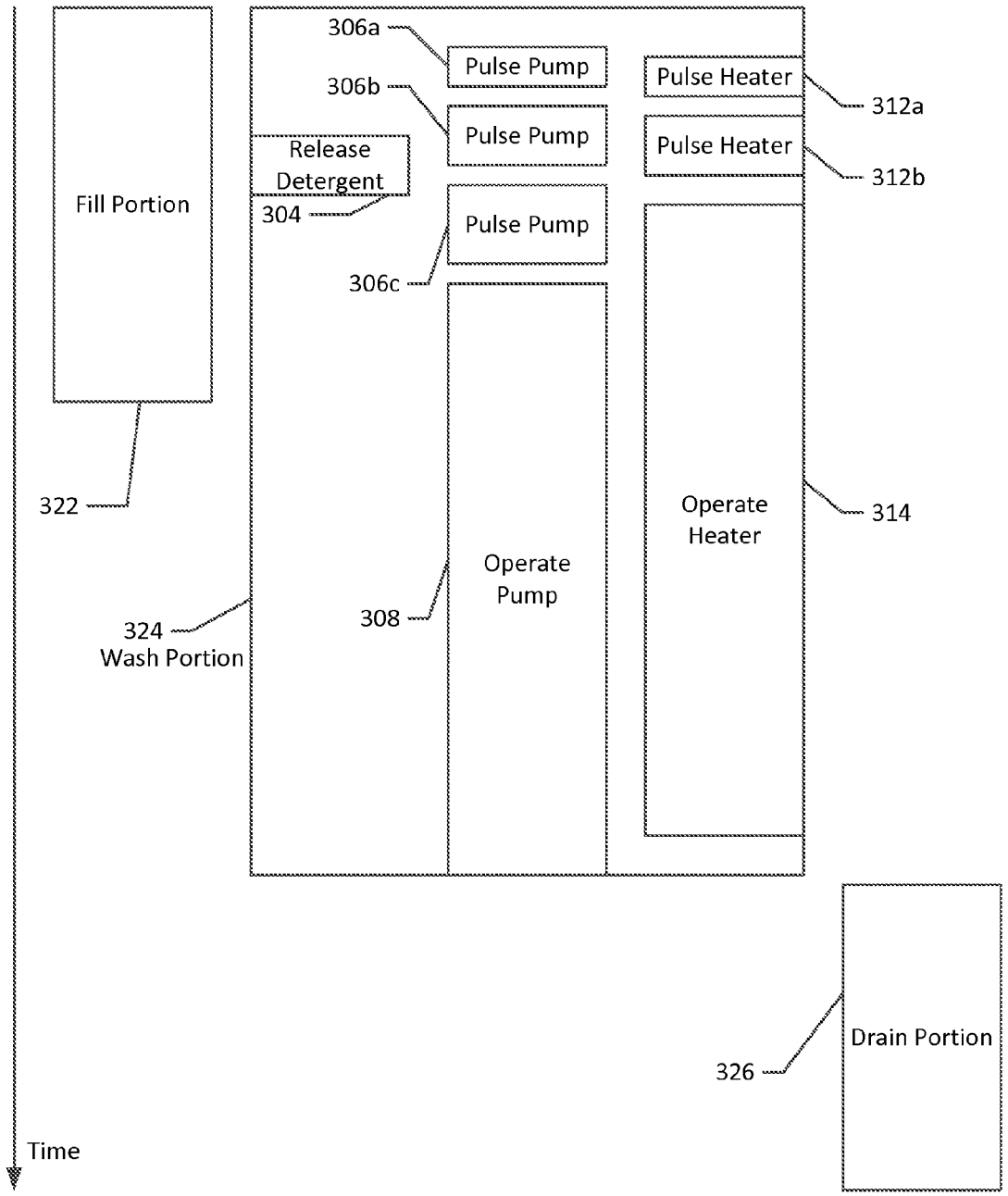
FIG. 4 is a schematic diagram of an example wash segment of a quick cycle dishwasher cycle, in accordance with some embodiments discussed herein.

FIG. 4 provides a schematic diagram of an example segment of a shortened dishwasher cycle. The segment illustrated in FIG. 4 may be, for example, a pre-wash segment 110 and/or a wash segment 120. In various embodiments, during the fill portion 322, a water fill valve 270 may be activated to add water to the tub 12. For example, the controller 240 may cause the water fill valve 270 to be activated. In various embodiments, a first amount of water may be added to the tub 12 for the segment of the shortened dishwasher cycle. The first amount of water is greater than a second amount of water that would be provided to the tub for a similar segment of a normal dishwasher cycle. For example, for a normal dishwasher cycle the minimum amount of water to complete a successful wash segment may be added to the tub 12 (e.g., enough water so that the amount of water is sufficient to run the circulation pump 50, 250 without cavitation), and in a shortened dishwasher cycle, a larger than minimum amount of water may be added to the tub. In one example, a wash segment in a normal dishwasher cycle may use one gallon of water and a wash segment in a shortened dishwasher cycle may use one and a half gallons of water. As water has a relatively high specific heat, adding a small amount of additional warm water to the tub 12 may provide noticeable additional heat to the dishware within the tub. Adding additional heat to the dishware within the tub 12 during the fill portion (e.g., 112, 122, 132) may cause the water and dishware within the tub 12 to more quickly come to a temperature or close to a temperature that optimizes the activity of the detergent during the present or during an upcoming cycle segment.

As illustrated in FIG. 4, the fill portion 322 and the wash portion 324 may overlap, at least in part, in some embodiments. For example, the detergent may be released (e.g., 304) as soon as the drain portion (e.g., 116) of the previous segment has ended (e.g., when the controller 40, 240 has deactivated the drain pump 42, 242). In another example, the detergent may be released (e.g., 304) at some point during the fill portion such as while the first amount of water is being provided to the tub. For example, in some embodiments the detergent could be released at the same time the fill portion begins (e.g., when the controller 40, 240 activates the water fill valve 270 to provide water to the tub 12) or shortly thereafter. In various embodiments, the detergent may be dissolved, charged, activated (e.g., in the case of enzymes or the like), and/or other similar words used interchangeably herein, before being released into the tub 12. For example, some water may be allowed to enter the detergent dispenser to dissolve the detergent within the detergent dispenser. Therefore, when the detergent is released into the tub 12, the detergent is at least partially dissolved. By releasing the detergent into the tub 12 earlier in the wash segment 120 and/or releasing the detergent after it has already been at least partially dissolved, charged, activated and/or the like, the detergent may begin working to clean the dishware earlier in the washing segment.

The circulation pump (e.g., 50, 250) may also be activated (e.g., via the controller 40, 240) before the fill portion 322 is complete. For example, the circulation pump (e.g., 50, 250) may be activated a predetermined time period after the fill portion 322 has begun. For example, the circulation pump (e.g., 50, 250) may be activated 30 seconds after the water fill valve 270 has been activated. In some embodiments, the dishwasher may include a water level sensor 210 configured to measure the water level within the tub 12. In such embodiments, the circulation pump (e.g., 50, 250) may be activated after the water level within the tub 12 reaches a predetermined level. In various embodiments, the circulation pump (e.g., 50, 250) may be activated in pulsed manner for at least a portion of the wash portion 324. For example, the circulation pump (e.g., 50, 250) may be pulsed by the controller (e.g., 40, 240) based on a predetermined timing sequence while the first amount of water is being provided to the tub to circulate the water within the tub. In various embodiments, as illustrated in FIG. 4, the circulation pump may be pulsed (e.g., 304*a*, 304*b*, 304*c*) for a part of the wash portion 324 and operated in a continuous manner (e.g., 308) for a part of the wash portion. Particularly, the circulation pump (e.g., 50, 250) may be pulsed when the water level in the tub 12 is too low or is expected to be too low to operate the circulation pump continuously without cavitation. In some embodiments, the predetermined timing sequence is defined such that a length of time of subsequent pauses of the circulation pump varies in manner related to the time the water fill valve has been activated to provide water to the tub, and/or as the estimated or monitored current water level within the tub. In various embodiments, the predetermined timing sequence is defined such that the length of time of subsequent pauses of the circulation pump (e.g., 50, 250) decrease as the length of time the water fill valve 270 has been activated to provide water to the tub increases and/or as the estimated or monitored current water level within the tub increases. In some embodiments, the predetermined timing sequence is defined such that a length of time of subsequent activation periods of the circulation pump varies in manner related to the time the water fill valve has been activated to provide water to the tub, and/or as the estimated or monitored current water level within the tub. In various embodiments, the predetermined timing sequence is defined such that a length of time of subsequent activation periods of the circulation pump varies in a manner based on the length of time the water fill valve has been activated and/or the estimated or monitored current water level within the tub such that enough water is present to properly operate the circulation pump during each activation period. In various embodiments, the predetermined timing sequence is defined such that the length of time of subsequent activation periods of the circulation pump increase as the length of time the water fill valve 270 has been activated to provide water to the tub increases and/or as the estimated or monitored current water level within the tub increases. In various embodiments, the estimated or monitored current water level within the tub may depend on the length of time the water fill valve has been activated and/or the like.

In embodiments in which the dishwasher includes a water level sensor 210 configured to measure the water level within the tub 12, the circulation pump 250 may be operated in a pulsed manner when the water level is measured below a first predetermined level and above a second predetermined level. The first predetermined level may indicate the water level above which the circulation pump 250 may be operated continuously without cavitation, which may be less than the level of the first amount (overfill level) of water. The second predetermined level may indicate the water level above which the circulation pump 250 may be operated in a pulsed manner without cavitation. In various embodiments, the circulation pump 250 may be operated in a pulsed manner (e.g., 304*a*, 304*b*, 304*c*) during a preset time period at the beginning and/or at another time in the wash segment 120 when water volume has been brought to a level below what is needed to maintain continuous pump operation without cavitation or carry under. For example, the circulation pump 250 may be operated in a pulsed manner starting 30 seconds after the water fill valve 270 was activated and may continue to be operated in a pulsed manner until 75 seconds after the water fill valve was activated. The circulation pump 250 may then be operated in a continuous manner for the remainder of the wash portion 324, in some embodiments. In various embodiments, the circulation pump 250 may be pulsed based on a predetermined timing sequence while the first amount of water is being provided to the tub to circulate the water within the tub. The circulation pump 250 may then be actuated in a constant manner in response to detecting that a water level within the tub reaches a predetermined water level.

In other embodiments, the wash portion 324 may overlap with the drain portion 326. In various embodiments, the circulation pump may again be activated in a pulsed manner for a set time period and/or in a predetermined manner after the drain pump 242 has been activated and/or when the water level within the tub 12 is between the first and second predetermined levels. In some embodiments, similar to the pulsed activation of the circulation pump in the overlap of the fill portion 322 and the wash portion 324, the activation periods and/or pause periods of the circulation pump 50 may vary in accordance with a predetermined timing sequence in a manner related to the time the water pump 242 has been activated to drain water from the tub 12, and/or as the estimated or monitored current water level within the tub. In various embodiments the activation periods of the circulation pump may decrease and/or the pause periods of the circulation pump may increase during the drain portion 326 in a manner related to the time the drain pump 242 has been activated to drain water from the tub 12, and/or as the estimated or monitored current water level within the tub.

By activating the circulation pump 250 before the fill portion 322 is complete, the dishware within the tub 12 may be sprayed with water earlier in the segment. Therefore, the length of the washing portion of the segment may be a larger fraction of the total segment/cycle time. For example, the overall time needed to complete the particular segment or complete the dishwasher cycle may be reduced without reducing the time spent in the washing portion(s) of the segment or cycle.

In various embodiments, a heating element 230 may also be activated (e.g., by the controller 240) during at least a part of the wash portion 324. The heating element 230 may be configured to heat the water within the tub 12. For example, the at least one heating element may be activated to heat the water within the tub 12 while the first amount of water is being provided to the tub. In some such embodiments, the heating element 230 may be activated in a continuous or pulsed manner after a preset time period after the water fill valve 270 has been activated (e.g., by the controller 240) to provide water to the tub 12. In embodiments in which the dishwasher includes a water level sensor 210, the heating element 230 may be activated in a pulsed or continuous manner when the water level within the tub 12 is above a predetermined level. For example, the at least one heating element may be activated in accordance with a second predetermined timing sequence. In various embodiments, the heating element may be operated in a pulsed manner (e.g., 312*a*, 312*b*) for at least one part of the wash portion 324 and operated in a continuous manner (e.g., 314) for at least one other part of the wash portion 324. This may, for example, allow for greater control of the heater sheath temperature of the heating element 230 and/or to reduce the risk of thermal shock to the heater sheath. In other embodiments, the heating element 230 may be activated (e.g., by the controller 240) and operated in a continuous manner for the entire part of the wash portion 324. By operating the heating element before the fill portion 322 is completed, the heating element may spend a larger fraction of the segment providing heat to the water and dishware within the tub 12.

As noted above, in some embodiments, the wash portion 324 and the drain portion 326 of the segment may overlap (e.g., the circulation pump 50 may continue to operate in a continuous and/or pulsed manner during a part of the drain portion 326). In other embodiments, the drain portion 326 may begin once the wash portion 324 has ended. During the drain portion 326, the drain pump 42 is activated (e.g., by the controller 40) to drain water from the tub 12 (e.g., via the drain hose 23). In various embodiments, the drain pump 42 may be operated to drain the water from the tub 12 for a predetermined period of time, until a water level within the tub 12 is below a predetermined "empty" level, until the pressure at the mouth of the drain pump falls below a predetermined "empty" pressure, and/or the like. When the drain pump 42 is deactivated (e.g., by the controller 40), the drain portion 326 is concluded, and, in some embodiments, the next segment of the dishwasher cycle may begin.

As noted above, in various embodiments, the circulation pump 250 and/or the heating element 230 may be pulsed (e.g., by the controller 240) based on a predetermined timing sequence. FIG. 5 provides an example timing sequence for an example embodiment of the present invention. In the illustrated example, the water fill valve 270 is activated (e.g., by the controller 240) at segment time t=0. For the next 30 seconds, water may be provided to the tub 12, as shown in line 1. The water provided to the tub 12 during the fill portion of a segment may make up or otherwise contribute at least a portion of the water within the tub during that particular segment. At segment time t=30 seconds, the water fill valve 270 remains activated, and the circulating pump 250 and the heating element 230 are activated (e.g., by the controller 240), as shown in line 2. As shown by line 3 of FIG. 5, the circulating pump 250 is only actuated for 1 second before being deactivated (e.g., by the controller 240). Thus, the circulating pump 250 is operated in a pulsed manner. At segment time t=31 seconds, the heating element 230 and water fill valve 270 remain activated, as also shown in line 3. At segment time t=43 seconds, the circulating pump 250 is again activated/pulsed (e.g., by the controller 240 and/or the like) for one second, as shown in line 4. Line 5 shows that at segment time t=44 seconds, the water fill valve 270 and heating element 230 remain activated. According to line 6, at segment time t=54 seconds, the circulating pump 250 is again activated/pulsed (e.g., by the controller 240) for one second. Line 7 shows that at segment time t=55 seconds, the water fill valve 270 and heating element 230 are still activated. According to line 8, at segment time t=65 seconds, the circulating pump 250 is activated (e.g., by the controller 240) for two seconds. Therefore, at segment time t=65 seconds, it is estimated or monitored that the current water level within the tub 12 is expected to be sufficient for operating the circulation pump for two seconds without cavitation. As shown by line 9, at segment time t=67 seconds, the water fill valve 270 and heating element 230 remain activated and the circulating pump 250 is deactivated. According to line 10, at segment time t=75 seconds, the circulating pump 250 is again activated (e.g., by the controller 240). By segment time t=75 seconds, it is estimated or monitored that the current water level within the tub 12 is sufficient for operating the circulating pump 250 continuously without cavitation. As shown by line 11, at segment time t=115 seconds, the fill portion of the segment is complete and the water fill valve 270 is deactivated (e.g., by the controller 240). Thus, by the end of the fill portion of the segment (e.g., at segment time t=115 seconds), the water level within the tub 12 is expected to have reached a designated level. In various embodiments, the designated water level may be an overfill level (e.g., a water level greater than a water level designed for operation). As shown in line 11, the circulating pump 250 and the heating element 230 continue to operate continuously for the remainder of the fill portion and/or wash portion of the segment. In the illustrated embodiment, when the circulating pump 250 is operating continuously (e.g., as shown in lines 10 and 11), the circulating pump may be operated at a higher speed (e.g., more rotations per minute (rpm)), than when the circulating pump is operating in a pulsed manner (e.g., as shown in lines 2, 4, 6, and 8). At segment time t=195 seconds, the wash portion of the segment may be complete such that the circulation pump 250 and the heating element 230 are deactivated and the drain pump 242 is activated (e.g., by the controller 240). The drain pump 242 may operate for 80 seconds, for example, to drain the water from the tub 12. The drain pump 242 may then be deactivated, and the segment is completed.

As should be understood, the above illustrated embodiment is an example of a predetermined timing sequence that may be used to operate a circulating pump and/or heating element in a wash portion of a segment that overlaps with at least one of the fill portion and the drain portion of the segment in order to reduce the time needed to complete the overall dishwasher cycle. A variety of other predetermined timing sequences may be utilized in keeping with the teachings presented herein. For example, in the above illustrated example, the heating element is operated in a continuous manner through the wash portion of the segment. In various embodiments, the heating element may be operated in a pulsed manner for at least a part of the wash portion. For example, the heating element may be operated in a pulsed manner during at least a part of the wash portion that overlaps with the fill portion, similar to the pulsing of the circulation pump 250 discussed above.

As noted above, in some embodiments, the dishwasher includes a water level sensor 210 configured to measure the water level within the tub 12 (e.g., a float switch, a sensor that measures the pressure due to the height of the water in the bottom of the tub 12/sump 14, etc.). In some such embodiments, the dishwasher may also include a siphon break device 60 configured to allow removal of cool water and/or water from the tub 12 (e.g., via drain hose 23 and/or the like) at any time during a wash segment. For example, the water may be provided to the tub 12 (e.g., via the water fill valve 270) as warm water, resulting in warm water within the tub. The warm water may then be sprayed onto cool and/or room temperature dishware within the tub 12. The warm water may impart some thermal energy to the dishware within the tub 12 (and the tub overall), thereby heating the dishware and cooling the wash fluid. Therefore, to continue to heat the dishware within the tub 12, the heating element will need to reheat the wash fluid and/or, if the warm water supply temperature is hotter than that of the dishware, additional warm water may be added to the water within the tub. Some embodiments, where the dishwasher has a water level sensor and a siphon break device, may be configured to remove a portion of the cool water from the tub 12 via the siphon break device. The water level sensor 210 may be used to monitor the water level within the tub 12 such that the water level within the tub does not fall below the minimum water level needed to operate the circulation pump 250 without cavitation. Warm water may then be added to the tub 12 to increase the overall temperature of the water in the tub. In this manner the temperature of the water and dishware in the tub 12 may efficiently be raised to a level approaching that of the warm water supply. Once the temperature of the water and dishware within the tub 12 has reached a level approaching that of the warm water supply, the temperature of the water and dishware within the tub may be further increased by the at least one heating element 230. Thus, the temperature of the water and dishware within the tub 12 may be efficiently raised to a temperature optimal for detergent performance and/or for the dissolution of fat, grease, and/or the like. By maintaining the water and/or dishware within the tub 12 at an optimal temperature for detergent performance and more quickly reaching temperatures necessary for the dissolution of fat, grease, and/or the like, the wash portion of the segment may not require as much time to effectively clean the dishware. Thus, using the drain pump in systems with a siphon break device 60 to remove cool water from the tub 12 may result in additional reductions in the amount of time needed to complete an effective dishwasher cycle. In various embodiments, the siphon break device 60 may be used to remove cool water from the tub 12 during one or more pre-wash segments, one or more wash segments, and/or one or more rinse segments.

In various embodiments, particularly in embodiments having a water level sensor 210 and/or siphon break device 60, warm water may be added and cool water removed from the tub 12 in a pre-determined manner to raise the temperature of the water and dishware within the tub 12. This method may be particularly helpful in raising the temperature of water and dishware within the tub 12 during a pre-wash segment 110. For example, the water fill valve 270 and the drain pump 242 may be simultaneously operated to add warm water and remove cool water from the tub 12. In another example, a sequence of timed steps may be used to remove cool water and add warm water to the tub 12. For example, in one embodiment, the water fill valve 270 and the drain pump 242 may be activated (e.g., by the controller 240) according to a predetermined timing sequence wherein the water fill valve is activated for 10 seconds and then the drain pump is activated for 8 seconds. This sequence of activating the water fill valve 270 and then activating the drain pump 242 may be repeated according to the predetermined timing sequence and/or until the temperature of the water and dishware within the tub reaches a predetermined temperature (e.g., the temperature of the warm water supply). In some embodiments, the water fill valve 270 may be activated for 10 seconds, and then 10 seconds later the drain pump 242 may be activated (e.g., a pause time is built-in). In such embodiments, the pause may last for a predetermined time or may be based on temperature measurements made within the tub 12 or sump 14. The pause may allow the warm water provided via the water fill valve 270 to exchange heat energy with the water and dishware within the tub 12. In some embodiments, the above described cold water removal and warm water add sequence may be performed during a pre-wash segment that does not involve the release of detergent (as removal of the cold water could dilute the concentration of the detergent in the water for washing of the dishware).

In various embodiments, a first amount of water may be provided to the tub during the filling portion of a segment. The first amount of water is a larger volume of water than a standard amount of water, wherein the standard amount of water is the volume of water provided to the tub for a segment of a normal dishwasher cycle. After a predetermined amount of time, a third amount of water may be removed from within the tub (e.g., drain pump and siphon break device combination, a drain pump and mechanically closed valve combination, etc.) such that the water level within the tub defines a normal operation water level. For example, the resulting water level within the tub may be similar to the water level in the tub during a normal dishwasher cycle (e.g., the standard amount of water). In various embodiments, the predetermined amount of time may be configured to allow heat from the water to be transferred to the dishware within the tub. In various embodiments, the third amount of water may be removed from the tub at a predetermined time that corresponds to an estimated time in which the water and dishware within the tub reaches and/or surpasses a predetermined temperature (e.g., 120° F., the temperature of the warm water supply, and/or the like). Then, since adding water from the water supply (which is at approximately 120° F.) may actually decrease the temperature of the water and/or dishware within the tub, the heating element may be used to raise the temperature (which will raise at a greater rate with the standard amount of water rather than the original first (greater) amount of water). As such, in various embodiments, the use of the overfill (to maximum thermal energy transfer from the warm water supply), reduction to a normal level, and use of the heating element provide an advantageous process to quickly raise the temperature of the water and dishware within the tub to effectively clean the dishware during the shortened dishwasher cycle.

In various embodiments, the controller 40 may be configured to operate the circulation pump 50 at a higher rate of speed (e.g., higher rotations per minute (rpm) and/or the like), with respect to the standard rate of speed at which the circulation pump is operated during a normal dishwasher cycle, when the water level within the tub is expected or monitored to be at or approximately at the first amount of water (which is greater than the standard amount of water used during a normal dishwasher cycle). In such embodiments, operating the circulation pump 50 at the increased speed with respect to the standard speed may increase the cleaning efficiency of the dishwasher cycle and may decrease the time needed to complete a shortened dishwasher cycle 400.

Figure 6:
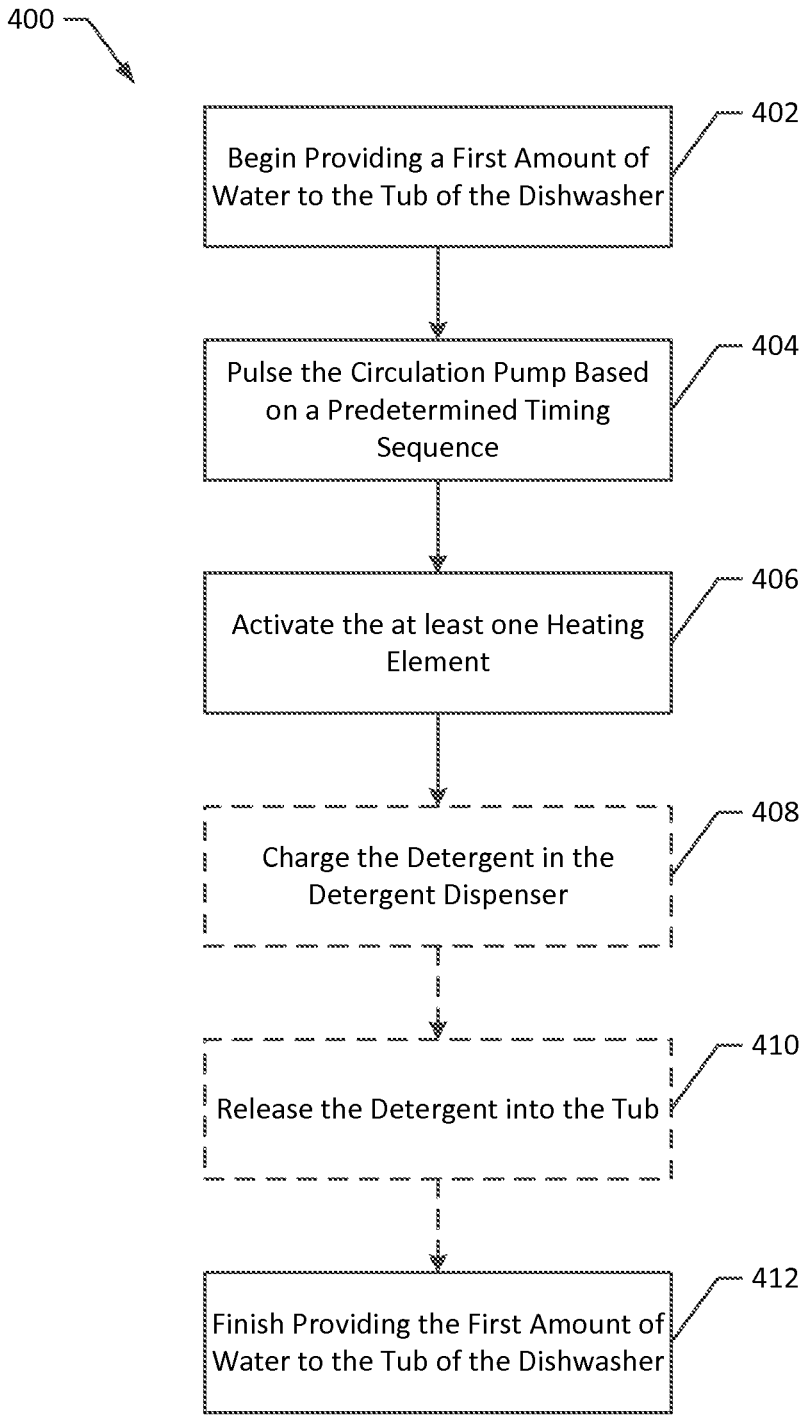
FIG. 6 is a flowchart illustrating example procedures and operations that may be completed in accordance with some embodiments discussed herein.

FIG. 6 illustrates a flow chart showing an example embodiment of a method for providing a shortened dishwasher cycle 400. As described with respect to FIG. 6, certain features or events may also reference specific steps in the segment diagram of FIG. 4. The operations illustrated in and described with respect to FIG. 6 may, for example, be performed by, with the assistance of, and/or under the control of one or more components of the dishwasher 10 (e.g., controller 40, water level sensor 210, drain pump 42, circulation pump 50, water valve 270, siphon break device 60, etc.). Operation 402 may comprise beginning to provide a first amount of water into the tub 12. The first amount of water is a larger volume of water than a standard amount of water provided to the tub 12 for a normal dishwasher cycle. The controller 40 may, for example, provide means for performing operation 402, such as by activating the water fill valve 270 to provide water into the tub 12. Operation 404 may comprise pulsing the circulation pump based on a predetermined timing sequence to circulate the water within the tub while the first amount of water is being provided to the tub. For example, the controller 40 may, for example, provide means for performing operation 404, such as by activating the circulation pump 50, 250 in a pulsed manner in accordance with a predetermined timing sequence as discussed above. Operation 406 may comprise activating the at least one heating element to heat the water within the tub while the first amount of water is being provided to the tub. The controller 40 may, for example, provide means for performing operation 406, such as by activating the at least one heating element as discussed above.

In some embodiments, operation 408 may comprise charging the detergent within the detergent dispenser 255. For example, the detergent dispenser may provide means for performing operation 408, such as by being configured to allow water within the tub (e.g., water running down the wall of the tub) to enter the detergent dispenser and charge the detergent, as discussed above. In some embodiments, operation 410 may comprise releasing the detergent into the tub 12. The controller 40 may, for example, provide means for performing operation 410, such as by causing the detergent dispenser 255 to release the detergent into the tub 12 as discussed above.

Operation 412 may comprise finishing providing the first amount of water to the tub 12. For example, the controller 40 may, for example, provide means for performing operation 412, such as by deactivating the water valve 270, causing water to cease being provided to the tub 12. The segment diagram depicted in FIG. 4 and described above represents only one possible pre-wash and/or wash segment of a shortened dishwasher cycle. Similarly, the method depicted in FIG. 6 and described above represents only one possible method for providing a shortened dishwasher cycle. It is understood that the illustrated steps in FIGS. 4 and 6 may be performed in any desired order and should not be limited to the illustrated embodiments. In some embodiments, certain ones of the steps described above may be modified, omitted, or further amplified. Furthermore, in some embodiments, additional optional steps may be included. Modifications, additions, omission, or amplifications to the steps above may be performed in any order and in any combination. The particular methods of providing a shortened dishwasher cycle will depend on any number of considerations, such as the level of soil of the dishware within the tub 12 to be washed, temperature of the water provided to the tub, the desired length of the shortened dishwasher cycle, and/or the like.

FIGS. 4 and 6 illustrate diagrams and/or flowcharts of methods, systems and program products according to various embodiments of the present invention. It will be understood that each block or step of the flowchart, and combinations of blocks in the flowchart, can be implemented by computer program instructions. These computer program instructions may be loaded onto a computer, processor, or other programmable apparatus to produce a machine, such that the instructions which execute on the computer, processor, or other programmable apparatus create means for implementing the functions specified in the flowchart block(s) or step(s). These computer program instructions may also be stored in a computer-readable memory that can direct a computer, processor, or other programmable apparatus to function in a particular manner, such that the instructions stored in the computer-readable memory produce an article of manufacture including instruction means which implement the function specified in the flowchart block(s) or step(s). The computer program instructions may also be loaded onto a computer, processor, or other programmable apparatus to cause a series of operational steps to be performed on the computer, processor, or other programmable apparatus to produce a computer implemented process such that the instructions which execute on the computer, processor, or other programmable apparatus provide steps for implementing the functions specified in the flowchart block(s) or step(s).

Accordingly, blocks or steps of the flowchart support combinations of means for performing the specified functions as well as combinations of steps for performing the specified functions and program instruction means for performing the specified functions. It will also be understood that each block or step of the flowchart, and combinations of blocks or steps in the flowchart, can be implemented by special purpose hardware-based computer systems which perform the specified functions or steps, or combinations of special purpose hardware and computer instructions, such as through controller 40.

Exemplary advantages of some embodiments of the present invention include reducing the time needed to complete an effective dishwasher cycle. Therefore, various embodiments of the present invention provide a shortened dishwasher cycle or quick cycle that may, in some cases, require less than thirty-five or forty minutes and/or approximately half an hour to effectively wash dishware. The provided shortened dishwasher cycle or quick cycle may even be effective at washing heavily soiled dishware in less than thirty-five or forty minutes and/or approximately half an hour.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included herein. Although specific terms are employed herein, they are used in a generic and descriptive sense only and not for purposes of limitation.

The invention claimed is:

1. A method for operating a shortened dishwasher cycle of a dishwasher, the dishwasher having a tub configured to hold dishware, at least one circulation pump, at least one heating element, and a controller configured to operate the dishwasher, wherein the controller is configured to operate the dishwasher according to at least one of a normal dishwasher cycle or the shortened dishwasher cycle, the method comprising:

providing a first amount of warm water to the tub;

pulsing the circulation pump based on a predetermined timing sequence to circulate the water within the tub while the first amount of water is being provided to the tub; and activating the at least one heating element to heat the water within the tub while the first amount of warm water is being provided to the tub.

2. The method of claim 1, further comprising releasing detergent into the tub while the first amount of warm water is being provided to the tub.

3. The method of claim 2, further comprising charging the detergent prior to releasing the detergent into the tub.

4. The method of claim 1, further comprising actuating the circulation pump in a constant manner in response to detecting that a water level within the tub reaches a predetermined water level.

5. The method of claim 1, wherein activating the at least one heating element comprises pulsing the at least one heating element according to a standard predetermined timing sequence.

6. The method of claim 1, wherein the predetermined timing sequence is defined such that a length of time of subsequent pauses of the circulation pump decreases as at least one of an estimated current water level or a monitored current water level within the tub increases.

7. The method of claim 1, wherein the predetermined timing sequence is defined such that a length of time of subsequent activation periods of the circulation pump increases in relation to an increase in at least one of an estimated current water level or a monitored current water level within the tub.

8. The method of claim 1, wherein the predetermined timing sequence is defined such that a length of time of subsequent activation periods of the circulation pump varies in a manner based on at least one of an estimated current water level or a monitored current water level within the tub during each activation period such that enough water is present to properly operate the circulation pump.

9. The method of claim 1, wherein the dishwasher further comprises a siphon break device and the method further comprises:

removing cool water from the tub via the siphon break device; and providing additional warm water to the tub.

10. The method of claim 1, further comprising, prior to providing the first amount of warm water to the tub, providing water from a warm water supply line to the tub for a first pre-determined amount of time and draining the water from the tub so as to clear cold water from the warm water supply line.

11. The method of claim 1, further comprising, prior to providing the first amount of warm water to the tub:

providing water to the tub from a warm water supply line for a first pre-determined amount of time;

comparing a monitored temperature of the provided water to a threshold temperature of the water; and draining the water from the tub if the monitored temperature is below the threshold temperature so as to clear cold water from the warm water supply line supply line.

12. The method of claim 11, further comprising repeating the steps of providing water, comparing the temperature, and draining the water if the monitored temperature is below the threshold temperature until at least one of the following occurs: a threshold volume of water has been provided to the tub; a threshold amount of time has elapsed; the monitored temperature reaches the threshold temperature; or the monitored temperature stops increasing from a previous iteration.

13. The method of claim 1, wherein (a) during the normal dishwasher cycle a second amount of warm water is added to the tub and (b) the first amount of warm water is greater than the second amount of warm water.

14. The method of claim 13, wherein providing the first amount of warm water to the tub causes a first rate of temperature increase within the tub that is greater than a second rate of temperature increase within the tub during the normal dishwasher cycle.

15. The method of claim 13, further comprising draining, after a predetermined amount of time, a third amount of water from within the tub such that a remaining water level within the tub defines a normal operation water level.

16. A dishwasher configured for running a shortened dishwasher cycle, the dishwasher comprising:

a tub configured to hold dishware;

a water fill valve configured to cause warm water to be provided to the tub;

a circulation pump configured to cause the water within the tub to be circulated within the tub;

at least one heating element configured to cause the water within the tub to be heated; and a controller in communication with the water fill valve, the circulation pump, and the at least one heating element, the controller configured to operate the dishwasher according to at least one of a normal dishwasher cycle or the shortened dishwasher cycle, the controller configured to:

actuate the water fill valve to provide a first amount of warm water to the tub;

pulse the circulation pump based on a predetermined timing sequence to circulate the water within the tub while the first amount of water is being provided to the tub; and activate the at least one heating element to heat the water within the tub while the first amount of water is being provided to the tub.

17. The dishwasher of claim 16, wherein the dishwasher further comprises a detergent dispenser, and wherein the controller is further configured to cause the detergent dispenser to release detergent into the tub while the first amount of water is being provided to the tub.

18. The dishwasher of claim 17, wherein the detergent dispenser is configured such that the detergent is charged by the addition of water to the detergent dispenser prior to the detergent being released into the tub.

19. The dishwasher of claim 16 wherein the controller is further configured to cause the heating element to be actuated in a pulsed manner according to a second predetermined timing sequence.

20. The dishwasher of claim 16, wherein the predetermined timing sequence is defined such that a length of time of subsequent pauses of the circulation pump decreases as at least one of an estimated current water level or a monitored current water level within the tub increases.

21. The dishwasher of claim 16, wherein the predetermined timing sequence is defined such that a length of time of subsequent activation periods of the circulation pump varies in a manner related to at least one of an estimated current water level or a monitored current water level within the tub.

22. The dishwasher of claim 16, wherein the predetermined timing sequence is defined such that a length of time of subsequent activation periods of the circulation pump varies in a manner based on at least one of an estimated current water level or a monitored current water level within the tub during each activation period such that enough water is present to properly operate the circulation pump.

23. The dishwasher of claim 16, wherein the dishwasher further comprises a siphon break device configured to enable removal of cool water from the tub, and wherein the controller is configured to actuate the drain pump to remove cool water via the siphon break device and actuate the water fill valve to provide additional warm water to the tub.

24. The dishwasher of claim 16, further including a warm water supply line and wherein the controller is further configured to, prior to actuating the water fill valve to provide the first amount of warm water to the tub, actuating the water fill valve to provide warm water to the tub for a first pre-determined amount of time and actuating the drain pump to remove the water from the tub so as to clear cold water from the supply line.

25. The dishwasher of claim 16, wherein the controller is further configured to, prior to actuating the water fill valve to provide the first amount of water to the tub:

actuate the water fill valve to provide water from a warm water supply line to the tub for a first pre-determined amount of time;

compare a monitored temperature of the water to a threshold temperature of the water; and actuate the drain pump to remove the water from the tub if the monitored temperature is below the threshold temperature so as to clear cold water from the warm water supply line.

26. The dishwasher of claim 25, wherein the controller is further configured to repeat the steps of actuating the water fill valve to provide the water, comparing the monitored temperature to the threshold temperature, and actuating the drain pump to remove the water if the monitored temperature is below the threshold temperature until at least one of the following occurs: a threshold volume of water has been provided to the tub; a threshold amount of time has elapsed; the monitored temperature reaches the threshold temperature; or the monitored temperature stops increasing from a previous iteration.

27. The apparatus of claim 16, wherein (a) during the normal dishwasher cycle a second amount of warm water is added to the tub and (b) the first amount of warm water is greater than the second amount of warm water.

* * * * *